US006808196B2

(12) United States Patent
Des Ouches

(10) Patent No.: US 6,808,196 B2
(45) Date of Patent: Oct. 26, 2004

(54) ELEMENT FORMING AN INCLINED WEDGE USED IN A SNOWBOARD BINDING

(75) Inventor: Pascal Joubert Des Ouches, Coublevie (FR)

(73) Assignee: Skis Rossignol S.A., Voiron (FR)

( * ) Notice: Subject to any disclaimer, the term of this patent is extended or adjusted under 35 U.S.C. 154(b) by 248 days.

(21) Appl. No.: 09/790,390

(22) Filed: Feb. 21, 2001

(65) Prior Publication Data

US 2001/0015542 A1 Aug. 23, 2001

(30) Foreign Application Priority Data

Feb. 22, 2000 (FR) ..... 00 02176

(51) Int. Cl.[7] ..... A63C 9/00
(52) U.S. Cl. ..... 280/636; 280/634
(58) Field of Search ..... 280/607, 617, 280/618, 620, 624, 633, 634, 636, 14.21, 14.22, 14.24

(56) References Cited

U.S. PATENT DOCUMENTS

| | | | | | |
|---|---|---|---|---|---|
| 3,917,298 | A | * | 11/1975 | Haff | 280/607 |
| 4,135,736 | A | | 1/1979 | Druss | 280/636 |
| 4,586,727 | A | | 5/1986 | Andrieu et al. | 280/607 |
| 5,044,654 | A | * | 9/1991 | Meyer | 280/613 |
| 5,135,250 | A | * | 8/1992 | Abondance et al. | 280/617 |
| 5,172,924 | A | * | 12/1992 | Barci | 280/14.22 |
| 5,503,900 | A | | 4/1996 | Fletcher | 428/160 |
| 5,913,531 | A | * | 6/1999 | Buquet | 280/626 |
| 5,954,357 | A | * | 9/1999 | Golling | 280/612 |
| 5,971,407 | A | * | 10/1999 | Zemke et al. | 280/14.22 |
| 5,984,345 | A | * | 11/1999 | Carter | 280/633 |
| 6,065,769 | A | * | 5/2000 | Simonetti et al. | 280/615 |
| 6,123,342 | A | * | 9/2000 | Grell | 280/11.36 |
| 6,189,911 | B1 | * | 2/2001 | Caron et al. | 280/607 |
| 6,328,328 | B1 | * | 12/2001 | Finiel | 280/636 |

FOREIGN PATENT DOCUMENTS

| | | | | |
|---|---|---|---|---|
| DE | 24 23 702 | * | 11/1975 | 280/636 |
| DE | 29 29 069 | * | 1/1980 | 280/607 |
| DE | 41 12 299 | * | 12/1991 | 280/607 |
| FR | 2 673 546 | * | 9/1992 | 280/14.22 |
| WO | WO98/42419 | | 10/1998 | |
| WO | WO 00/30722 | | 6/2000 | |

* cited by examiner

*Primary Examiner*—Frank Vanaman
(74) *Attorney, Agent, or Firm*—Heslin Rothenberg Farley & Mesiti P.C.; John Pietrangelo

(57) ABSTRACT

An element forming an inclined wedge, intended to be integrated with the front or rear end of the base plate of a snowboard binding, or directly with the upper face (5) of a snowboard, is disclosed. The element includes an upper face (9) intended to receive the bearing forces of the front or rear end of the sole of a boot, and having a mechanism for adjusting the angle of inclination, measured in a longitudinal plane, between the upper face of the element and the base plate of the binding or the upper face of the snowboard. The element may also provide a mechanism (30, 31) for adjusting the longitudinal position of the element in relation to the binding or snowboard.

22 Claims, 4 Drawing Sheets

ELEMENT FORMING AN INCLINED WEDGE USED IN A SNOWBOARD BINDING

TECHNICAL FIELD

The invention relates to the field of sports involving sliding and more specifically to that of snowboarding. It relates more particularly to an interface element, which is mounted between the ends of the sole of the boot and the binding of the snowboard, for filling the empty space existing between the sole and the binding of the board. In the field of snowboarding, the term "gas pedal" is usually applied to such interface elements.

PRIOR ART

As is known, snowboarding is performed using either hard boots resembling boots for Alpine skiing or soft boots interacting with bindings having original elements, in particular a rear channel intended to provide support for the soft boot. The invention is concerned more specifically with this family of soft boots and adapted bindings. The reason such boots are used is their quality of comfort, which allows the user to walk freely when he has removed his board.

Moreover, to allow a good rolling motion of the foot during walking movement, the soft boots have a sole which has a slight curvature so that the front and rear ends are slightly raised.

It can therefore be understood that, when the boot is mounted on the binding, there is at the front and/or rear ends of the boot a certain unoccupied volume between the bottom of the sole of the boot and the upper face of the base plate of the binding, or indeed the board itself depending on the design of the binding used. This volume free of material does not therefore allow the user to transmit forces at the front and/or rear ends of the foot which it is known, moreover, constituted one of the principal zones for transmission of bearing forces.

It is to be noted that this problem of the effective transmission of bearing forces is greater at the front end of the boot because the support at the rear end of the boot is provided predominantly by the rear channel of the binding. Nevertheless, the absence of effective support at the rear of the heel of the boot causes inaccuracy as far as the sensations received and therefore the control of the board are concerned.

Solutions have already been proposed for solving this problem.

Document U.S. Pat. No. 5,503,900 describes a binding, the base plate of which comprises additional elements located at the front and rear ends. These elements form inclined wedges, the upper surface of which is intended to come into contact with the sole of the boot at the front and the rear. In this manner, the forces exerted in the vicinity of the toe of the boot are transmitted in the direction of the base plate via this element forming a wedge. The play between the sole of the boot and the upper face of the base plate is eliminated, which allows forces to be transmitted immediately there is movement of the toe of the foot. The major disadvantage of these elements forming wedges is that they cannot be adapted to different boot sizes, and it is therefore necessary to reposition them each time the user changes boots.

Furthermore, document WO 98/42419 proposes making the wedges adjustable in their longitudinal and transverse positions so as to be capable of being adapted to different sole configurations. However, as the element has a given shape, it cannot correspond to all the sole shapes of the boots on the market. Such a solution therefore has the major disadvantage that, depending on the different boot sole curvatures, a certain play can occur between the sole and the element forming a wedge. This play produces the disadvantageous effects mentioned above.

Document WO 00/30722 proposes equipping the base plate of a snowboard binding with an articulated wedge. More specifically, this wedge comprises two lateral tabs which permit the adjustment of its inclination in relation to the base plate. This solution allows adaptation to different curvatures of the front of the boot. However, it does not take account of the fact that the differences in the curvature of the front of the boot generally correspond to different sizes and therefore to different boot lengths.

One of the problems the invention proposes to solve therefore is that of optimizing the contact between the element forming a wedge and the sole of the boot so as to obtain the best possible transmission of forces whatever the size and the geometry of the boot.

DISCLOSURE OF THE INVENTION

The invention therefore relates to an element forming a wedge, intended to be integrated with the front or rear end of the base plate of a snowboard binding, or directly with the upper face of the snowboard. This element has an upper face intended to receive the bearing forces of the front or rear end of the sole of the boot.

This element forming an inclined wedge comprises means of adjusting the angle of inclination, measured in a longitudinal plane, between the upper face of the inclined wedge and the upper face of the board so as to be adaptable to several boot geometries.

According to the invention, the element forming a wedge is characterized in that it also comprises means capable of adjusting the longitudinal position of the upper face of the wedge in relation to the base plate of the binding.

In other words, the characteristic element has a variable geometry which allows adaptation to different types and sizes of boot sole by filling in an integral manner the volume comprised between the snowboard and the bottom of the sole. The angle of inclination is measured in a longitudinal plane which is perpendicular to the board and in the direction of orientation of the foot. Thus, when the user changes boots and the sole of his new boots is more raised at the front end or longer, all he has to do to ensure that his bearing forces are transmitted just as effectively as with the former adjustment is to modify the inclination of the upper face of the wedge and the longitudinal position of the latter.

The characteristic element can also comprise means capable of adjusting the angle of inclination, measured in a transverse plane, between the upper face of the wedge and the upper face of the board so as to be adapted to a transversely inclined position of the boot. In this manner, it is possible to optimize the position of the foot by a transverse inclination or canting, while retaining good transmission of the bearing forces at the front end of the boot.

In a particular embodiment, the element forming a wedge according to the invention comprises:

- a lower plate integrated with the base plate of the binding or with the snowboard,
- an upper plate, the upper face of which is intended to receive the bearing forces of the boot, said upper plate being articulated in relation to the lower plate, means capable of adjusting both the relative inclination and the relative longitudinal position of the two plates, lower and upper, in relation to one another.

In certain particular cases, the lower plate can form an integral part of the base plate, of which it then constitutes an extension toward the front. In other cases, the element is completely separate from the base plate and is mounted on the latter, or indeed on the board, at the front end of the base plate.

In the case in which the lower plate is fixed to the base plate, it is possible to make provision to adjust the longitudinal position of the anchoring point of said plate on the base plate in order to obtain the characteristic adjustment.

In a first embodiment, the means capable of adjusting the inclination of the two plates comprise at least one screw interacting with the two plates, lower and upper. In a first variant embodiment, the lower plate has a thread receiving said screw, and the upper plate rests on the head of this screw so that the latter works under compression. In other words, when the screw undergoes the screwing movement, the screw moves into the thread and the upper plate moves closer to the lower plate. In practice, the upper plate can advantageously have a recess capable of receiving the head of the screw, this recess then having an aperture opening on the upper face of the upper plate in order to allow access to said screw head. It is thus possible to avoid the elements projecting in relation to the upper face of the wedge.

According to another variant embodiment, the lower plate comprises a thread receiving the screw, and it is the head of the screw which bears on the upper plate, so that the screwing-in of the screw causes the upper plate to move closer to the lower plate, return means being provided to oppose this moving closer. These return means are sufficiently rigid under compression to avoid any rocking of the boot when forces are exerted.

In certain embodiments, the upper plate can have a vertical flap oriented in the direction of the lower plate and capable of closing the aperture between the two plates in order to limit the ingress of snow. In another variant, the space comprised between the two plates can be filled with a compressible foam so as to prevent the ingress of snow.

In another variant embodiment, the means capable of adjusting the inclination can consist of a movable piece, the position of which is set in relation to the lower plate and the upper zone of which comes into contact with the lower face of the upper plate in order to bring about the inclination in relation to the lower plate.

In practice, the movable piece can comprise:

a serrated base intended to interact with the serrated face of the lower plate with which it comes into contact;

at least one stud which is mounted on said base and the upper face of which forms the zone which comes into contact with the upper plate.

In practice, the articulation of the two plates, lower and upper, can advantageously be brought about by a connection member capable of laying the two plates flat one against the other. The upper plate advantageously has a curve in the region of the zone of interaction with said connection member so as to allow the inclination of the plates in relation to one another to be brought about. In this manner, the inclination movement of the upper plate is permitted without giving rise to mechanical stresses on this plate.

In practice, the zones of contact of the lower and upper plates advantageously have complementary serrations capable of bringing about locking in the longitudinal position of the two plates in relation to one another. In this manner, any risk is eliminated of the upper plate being shifted in relation to the lower plate when it is subjected to forces.

In practice, the lower plate advantageously has a longitudinal throat, in which a portion of the connection member can be displaced in order to bring about the longitudinal adjustment of the upper plate in relation to the lower plate, the locking in position being effected by the abovementioned serrated zones.

In practice, the wedge can advantageously comprise two adjustment screws situated on either side of the longitudinal median plane of the element so as to bring about a distribution of the forces which limits the risks of breakage and mechanical problems.

In practice, the wedge can advantageously comprise a transverse strip interacting with the two screws so as to bring about better distribution over the entire width of the wedge of the forces exerted by the upper plate.

In practice, the wedge can advantageously comprise a seal interposed between the lower and upper plates. In a particular embodiment, a layer of plastic material capable of hiding the screw heads can be provided.

BRIEF DESCRIPTION OF THE FIGURES

The manner of embodying the invention, and the advantages deriving therefrom, will emerge clearly from the description of the various embodiments given below with reference to the appended figures, in which.

MODES OF EMBODYING THE INVENTION

Figure 1A:
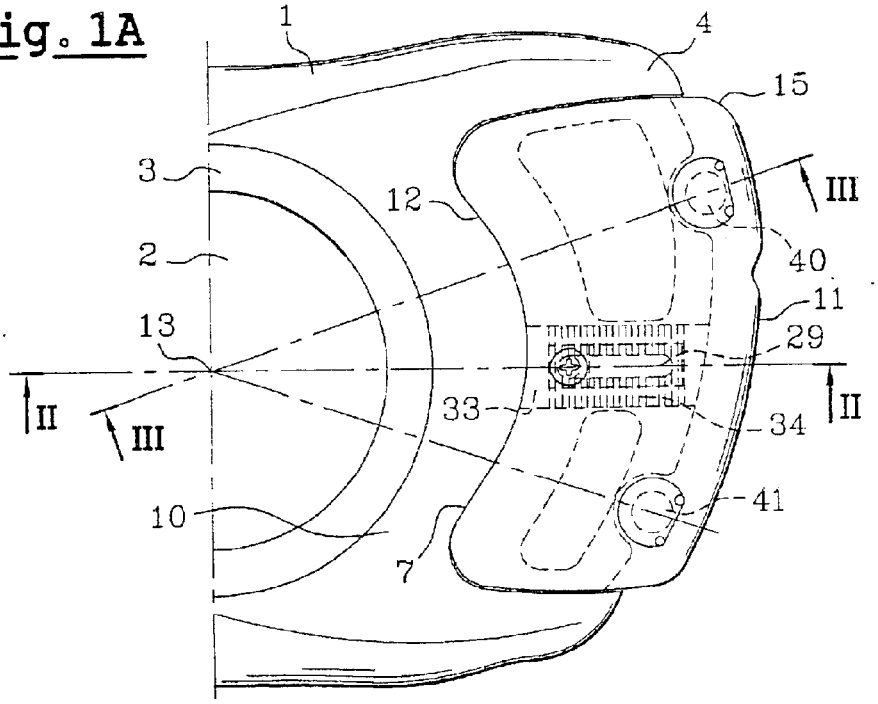
FIGS. 1*a* and 1*b* are top views of a base plate of a snowboard binding equipped with an element according to the invention, shown in two configurations.
Figure 1B:
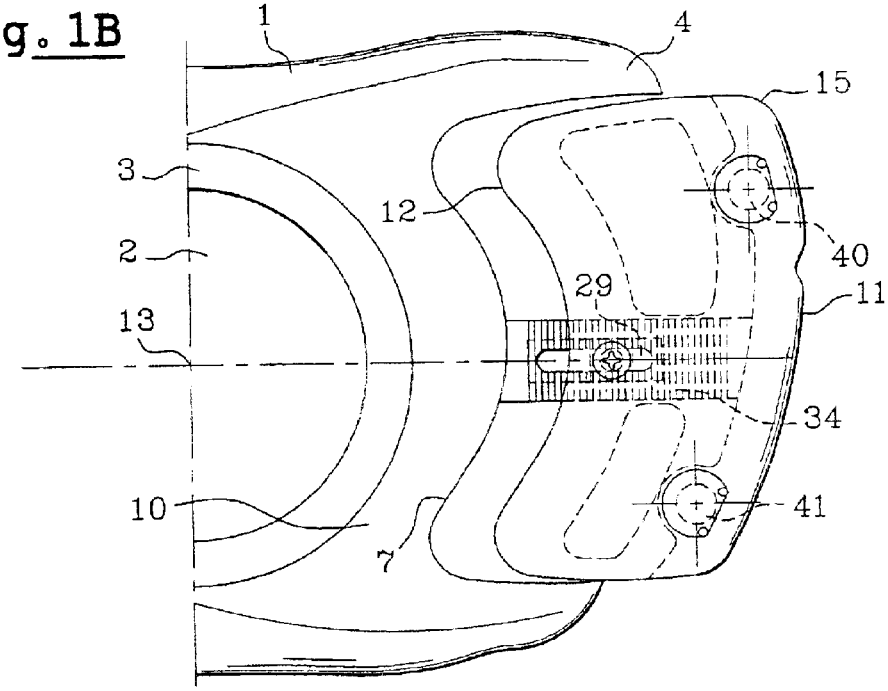
Figure 2:
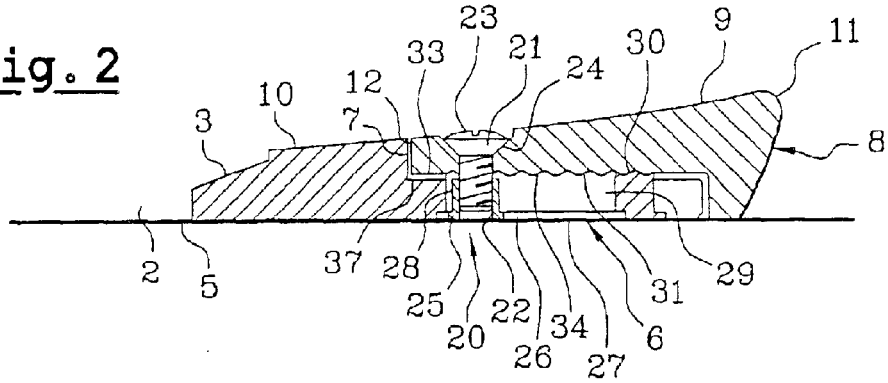
FIG. 2 is a sectional view of FIG. 1 along the plane II-II'.

As already mentioned, the invention relates to an element forming a wedge intended to be mounted at the front and/or at the rear of a snowboard binding in order to fill the volume comprised between the upper face of the board and the bottom of the sole, when the latter is curved upward. Several designs can be used, all observing the same principle, according to which the inclination of the upper face of the wedge can be adjusted.

First Mode of Embodying the Invention

FIGS. 1*a*, 1*b* and 2 to 5 relate to a first embodiment, in which the front portion of the base plate (1) constitutes one of the plates of the characteristic element. More specifically, this base plate has in its center an aperture (2) intended to receive the disk for adjusting the orientation of the binding. The chamfered portion (3) actually serves for locating the disk (not shown).

The front portion (4) of the base plate rests directly on the upper face (5) of the board. This front portion (4) of the base plate forms in its end portion at the front a lower plate (6), above which a set-back (7) is formed, which allows the mounting of the upper plate (8) in such a manner that the upper face (9) of this upper plate (8) forms the continuation of the upper face (10) of the central portion of the base plate. The upper plate (8) is delimited at the front and at the rear by circular-arc-shaped ridges. The rear ridge (12) is centered approximately on the centre (13) of the binding, while the front ridge (11) follows the shape of the foot and therefore extends slightly further forward on the inner side (15) of the foot.

The upper plate (8) is integrated with the lower plate (6) or the front end of the base plate by a connection member (20) constituted by a screw (21) and a nut (22) with a shoulder. The head (23) of the screw is inserted into a recess (24) provided for this purpose on the top of the upper plate (8), and the shoulder nut (22) has its zone (25) of greater diameter accommodated inside a throat (26) provided for this purpose below the lower face (27) of the base plate corresponding to the lower plate of the wedge. The portion of smaller diameter (28) of the shoulder nut (22) can be displaced in a longitudinal aperture (29) formed within the lower plate (6). In this manner, the connection member (20) and therefore the upper plate (8) can be displaced longitudinally between the two positions illustrated in FIGS. 1*a* and 1*b*.

The upper plate (8) is held in position in relation to the lower plate (6) on the one hand by the tightening of the connection member (20) and on the other hand by the interaction of two opposite surfaces (30, 31) which are advantageously serrated.

According to a characteristic of the invention, the upper plate (8) can be oriented in relation to the lower plate (6) for adaptation to different boot geometries. This orientation is achieved by pivoting the upper plate (8) about the connection member (20) in relation to the lower plate (6) or the end of the base plate. This is the reason why those portions (33, 34) of the lower face of the upper plate (8) situated in front of and behind the connection member (20) are not coplanar but on the contrary have a slight inclination so that, when the upper plate (8) pivots about the connection member (20), that portion (33) of the upper plate (8) situated at the rear of the connection member (20) can move closer to the upper face (37) of the lower plate (6) corresponding to the limit of the set-back (7).

Figure 3:
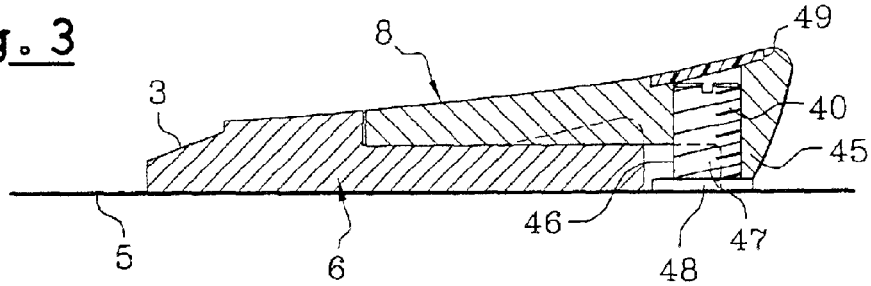
FIG. 3 is a sectional view of FIG. 1 along the plane III-III'.
Figure 4:
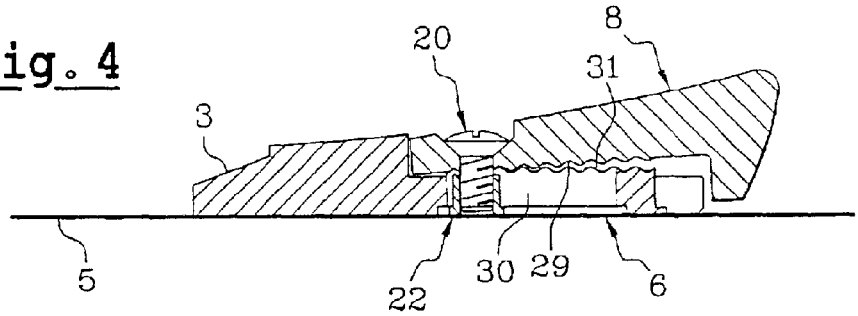
FIG. 4 corresponds to FIG. 2, the geometry of the characteristic element having been modified.

The desired orientation position is maintained by virtue of two screws (40, 41) situated close to the front ridge (11) of the upper plate (8). More specifically, as illustrated in FIG. 3, the front portion of the upper plate (8) has a flap (45) which is directed downward and, when the upper plate (8) is in its lowest position, comes virtually into contact with the upper face (5) of the board.

Figure 5:
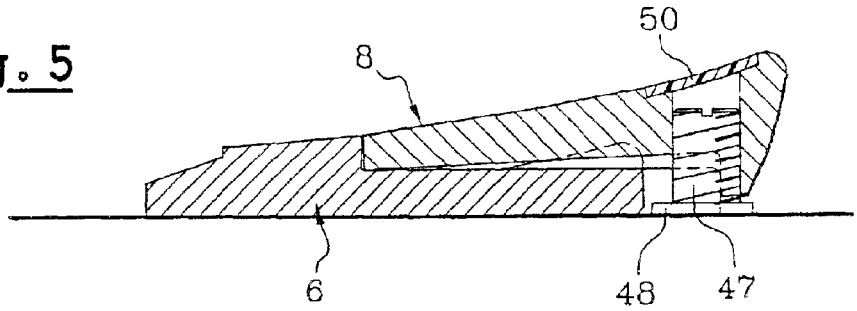
FIG. 5 corresponds to FIG. 3 when the geometry of the wedge has been modified.

The front portion of the upper plate (8) comprises, in its lateral zones, two threads (46), in which a threaded rod (47) can be screwed in, the lower zone of which comprises a disk (48) intended to come into contact with the upper face (5) of the board. The upper portion of the threaded rod (47) is accessible via the upper face (9) of the upper plate (8) at a recess (49) which is provided for this purpose and can advantageously be closed by a plug (50) made of plastic material. When the user exerts a screwing force on the upper portion of the threaded rod (47), he brings about its descent within the thread (46) of the upper plate. Since the disk (48) comes into contact with the upper face of the board, the result is that, by reaction, the upper plate (8) rises. The result is illustrated in FIG. 5, in which it can be seen that the upper plate is shifted slightly upward, both at the side (see FIG. 5) and in the center (see FIG. 4). The variation in inclination can be up to 30°.

Second Mode of Embodying the Invention

Figure 6:
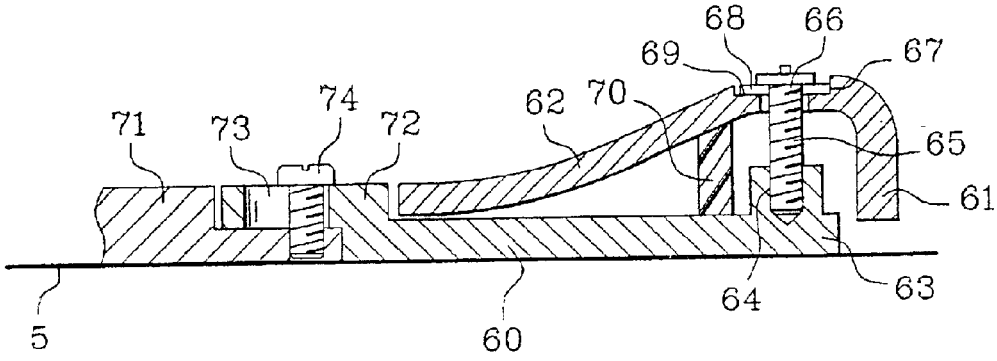
FIG. 6 is a sectional view of a variant embodiment of the present invention.

FIG. 6 illustrates a variant embodiment, in which the lower plate (60) extends to close to the flap (61) of the upper plate (62). In its end portion, the lower plate (60) comprises a zone (63) including a thread (64), in which a screw (65) moves, the head (66) of which passes through the upper plate (62) at a recess (67) provided for this purpose. The head (66) of the screw (65) can be accompanied by a washer (68) intended to bring about good distribution of the forces at the shoulder (69) of the recess (67). When the screw (66) is screwed into the thread (64), the head (65) of the screw and the associated washer (68) draw the upper plate (62) downward. Return means, such as a stud (70) made of elastic foam or springs (not shown) oppose the displacement of the upper plate (62) downward.

The longitudinal adjustment of the wedge is achieved by modifying the position of the lower plate (60) in relation to the base plate (71). For this purpose, the base plate (71) and the rear portion (72) of the lower plate (60) have a zone of overlap. The rear portion (72) of the upper plate has a longitudinal slot (73) passed through by a screw (74) screwed into the front end of the base plate.

Figure 7:
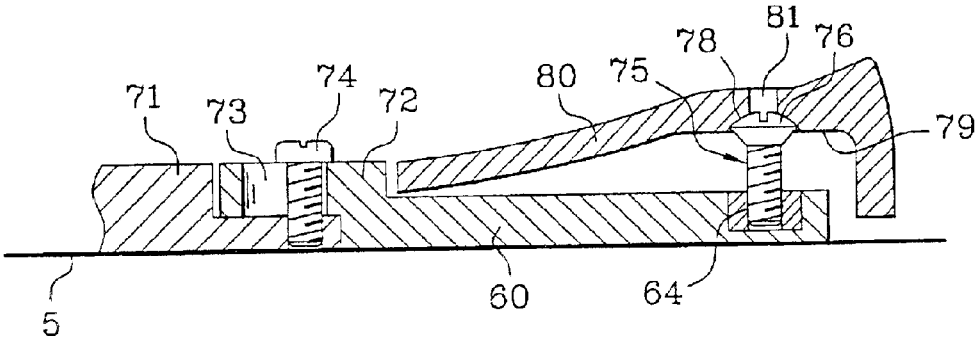
FIG. 7 is a sectional view of another variant embodiment of the present invention.

A variant embodiment illustrated in FIG. 7 functions according to a mechanically similar principle. The screw (75) which moves into the thread (64) of the lower plate (6) has a spherical head (76) which comes into contact with a recess (78) of complementary shape formed in the lower face (79) of the upper plate (80). This recess (78) opens via an aperture (81) of smaller diameter to allow access to the screw head (76). In this embodiment, the screw head (76) supports the forces transmitted by the upper plate (80) and therefore works under compression.

In all the embodiments illustrated, provision can be made to arrange a seal between the upper and lower plates in order to avoid ingress of snow between the plates. It is also possible to fill the space with an easily compressible foam in order to prevent any ingress of snow.

It will of course be understood that when the two screws move into their corresponding thread to a different extent, the result is a slight transverse orientation of the upper plate, which is particularly suitable when the user is adjusting the canting of the binding.

In an embodiment which is not shown, the wedge can also comprise a transverse plate which comes to bear on the two screws so as to distribute the forces exerted on these in a homogeneous manner.

Third Mode of Embodying the Invention

Figure 8:
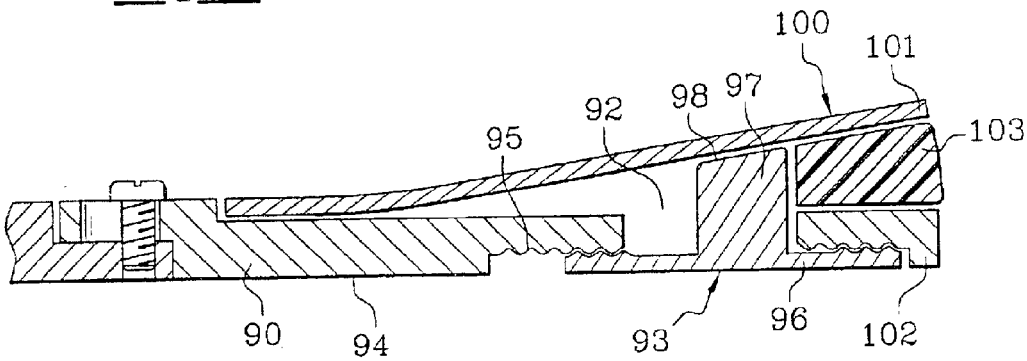
FIG. 8 is a sectional view a further variant embodiment of the present invention.
Figure 9:
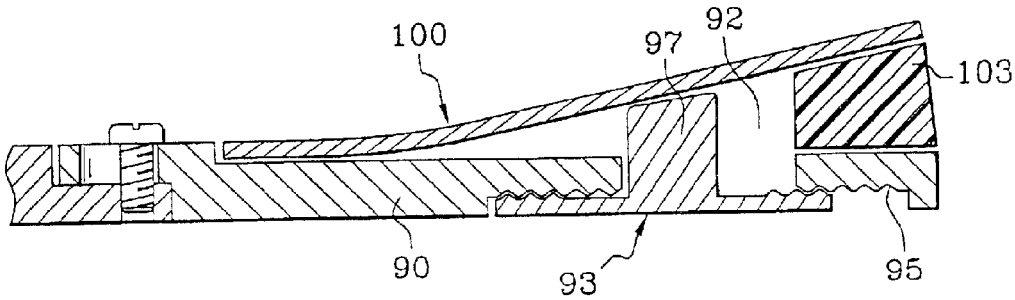
FIG. 9 is a sectional view of the variant embodiment shown in FIG. 8 illustrating an alternate position for the moveable piece.

FIGS. 8 and 9 illustrate another embodiment of the invention, in which the lower plate comprises an aperture (92), into which a movable piece (93) can pass. More specifically, the lower face (94) of the lower plate (90) comprises around the aperture (92) a transversely serrated area (95). The aperture (92) receives the movable piece (93) consisting of a base (96) and a stud (97) arranged approximately in its center. The upper face of the base (96) is serrated in the same manner as the area (95) opposite which it is located. In this manner, the movable piece (93) can be displaced longitudinally in order that the stud (97) adopts a position which is set within the aperture (92). The upper portion (98) of the stud comes into contact with the lower face of the upper plate and therefore receives the forces transmitted by this upper plate (100). Depending on the position of the movable piece (93) within the area (95) and the aperture (92), the stud (97) bears against the underside of the upper plate (100) at a different longitudinal location. The upper plate (100) is fixed to the lower plate (90) by any mechanical means.

The result is that the inclination of the latter (100) varies depending on the position of the movable piece (93) as illustrated in FIGS. 8 and 9. The movable piece (93) is held in position by the serration of the upper face of its base (96) and of the area (95). This serration can even utilize engaging shapes which bring about a slight ratchet-type engagement. The front ends (101, 102) of the lower plate (90) and of the upper plate (100) can be connected by a stud (103) of compressible foam which brings about on the one hand support toward the front and on the other hand sealing of the assembly. The movable piece (93) can of course comprise only one stud, situated in the center of the characteristic element, or indeed several studs distributed over the width of the wedge in order to bring about better distribution of forces.

The longitudinal adjustment of the wedge is achieved as in the variants illustrated in FIGS. 6 and 7 by modifying the position of the lower pate (90) in relation to the base plate (71).

It emerges from the above that the element forming a wedge according to the invention, known as a "gas pedal", has numerous advantages, in particular:

- the possibility of adjusting the orientation of its upper face in relation to the upper face of the board, which allows adaptation to different boot curvatures;
- the possibility of adjusting a transverse inclination of this upper face of the wedge;
- excellent sealing;
- a distribution of the forces which reduces the risk of mechanical breakage; and
- the possibility of adjusting the longitudinal position of the upper face of the wedge for adaptation to different boot sizes and lengths.

What is claimed is:

1. An element for use with a snowboard or snowboard binding for receiving a boot, the element mounted to an upper face of a snowboard or snowboard binding, the element comprising:

- an upper face adapted to receive a front or a rear end of a sole of the boot, and having an angle of inclination measured between the upper face of the element and the upper face of the snowboard or snowboard binding in the direction of orientation of the boot;
- means for adjusting the angle of inclination of the upper face;
- means for adjusting the position of the element in relation to the upper face of the snowboard or snowboard binding in the direction of orientation of the boot;
- a lower plate mounted to the upper face of the snowboard or snowboard binding;
- an upper plate bearing the upper face and being articulated in relation to the lower plate; and
- wherein the means for adjusting the angle of inclination of the upper face comprises means for adjusting the relative inclination of the lower plate and the upper plate in relation to one another and the means for adjusting the position of the element comprises means for adjusting the relative position of the lower plate and the upper plate in relation to one another.

2. The element as claimed in claim 1, wherein the upper face of the element further comprises an angle of inclination measured between the upper face and the upper face of the snowboard or snowboard binding in the direction substantially perpendicular to the direction of orientation of the boot, and the element further comprises means for adjusting the angle of inclination in the direction substantially perpendicular to the direction of orientation of the boot.

3. The element as claimed in claim 1, wherein the means for adjusting the inclination of the lower plate and upper plate comprises at least one screw interacting with the lower plate, and the upper plate.

4. The element as claimed in claim 3, wherein the lower plate comprises a thread receiving the at least one screw having a head, and wherein the upper plate rests on the head of the screw.

5. The element as claimed in claim 4, wherein the upper plate comprises a recess for receiving the head of the screw, and wherein the recess comprises an aperture opening on the upper face of the plate to allow access to the screw head.

6. The element as claimed in claim 3, characterized in that the lower plate comprises a thread for receiving the screw having a head, wherein the head of the screw bears on the upper plate, wherein rotating the screw causes a reduction of the angle of inclination of the upper plate in relation to the lower plate, and wherein a return means opposes the reduction in the angle of inclination.

7. The element as claimed in claim 3, wherein the element comprises a longitudinal median plane, and wherein the at least one screw comprises two adjustment screws situated on either side of the longitudinal median plane of the element.

8. The element as claimed in claim 7, further comprising a transverse strip which interacts with the two adjustment screws and the upper plate, wherein the transverse strip distributes the forces exerted on the upper plate over the two adjustment screws.

9. The element as claimed in claim 3, further comprising a layer of plastic material capable of hiding the at least one screw.

10. The element as claimed in claim 1, further comprising an aperture between the upper plate and the lower plate, wherein the upper plate comprises a vertical flap oriented in the direction of the lower plate, the vertical flap adapted to close the aperture to limit the ingress of snow into the aperture.

11. The element as claimed in claim 1, wherein the means for adjusting the relative inclination of the lower plate and the upper plate comprises a movable piece having an upper zone which contacts the upper plate, and wherein movement of the movable piece provides adjustment of the relative inclination of the lower plate and the upper plate.

12. The element as claimed in claim 11, wherein the lower plate comprises a serrated face, and wherein the movable piece comprises:

- a serrated base adapted to interact with the serrated face; and
- at least one stud mounted on the serrated base, the at least one stud having an upper face which contacts the upper plate.

13. The element as claimed in claim 1, characterized in that the lower plate is mounted for adjustment to the upper face of the snowboard or snowboard binding.

14. The element as claimed in claim 1, characterized in that the lower plate comprises an integral part of the upper face of the snowboard or snowboard binding.

15. The element as claimed in claim 1, further comprising a space between the upper plate and the lower plate, wherein the space is filled with a compressible foam to prevent the ingress of snow in to the space.

16. The element as claimed in claim 1, further comprising a connection member for connecting the lower plate to the upper plate at a zone of interaction, wherein the upper plate and the lower plate may lay flat, one against the other, and wherein the upper plate comprises a curve in the region of the zone of interaction, wherein the curve of the upper plate allows the angle of inclination of the upper plate relative to the lower plate to be varied.

17. The element as claimed in claim 16, characterized in that the upper plate and the lower plate each comprise complementary serrations in the zone of interaction which limit the movement of the upper plate relative to the lower plate.

18. The element as claimed in claim 16, characterized in that the lower plate comprises a throat through which a portion of the connection member can be displaced to provide adjustment of the upper plate in relation to the lower plate.

19. The element as claimed in claim 1, further comprising a seal interposed between the lower plate and the upper plate.

20. The element as claimed in claim 1, wherein the element is adapted for receiving a soft boot.

21. The element as claimed in claim 1, wherein the element is adapted for receiving a boot having a curved sole.

22. The element as claimed in claim 1, wherein the element comprises an inclined wedge.

* * * * *